United States Patent [19]

Brown

[11] Patent Number: 4,943,731

[45] Date of Patent: Jul. 24, 1990

[54] APPARATUS FOR HANDLING SOURCE CAPSULE ASSEMBLIES

[76] Inventor: Glen A. Brown, 36 Hester Street, Dartmouth, Nova Scotia, Canada, B3A 1K2

[21] Appl. No.: 423,231

[22] Filed: Oct. 18, 1989

[30] Foreign Application Priority Data

Oct. 19, 1988 [GB] United Kingdom ..... 8824452

[51] Int. Cl.[5] ..... G21F 5/02

[52] U.S. Cl. ..... 250/497.1

[58] Field of Search ..... 250/497.1; 378/204, 378/210

[56] References Cited

U.S. PATENT DOCUMENTS

| | | | |
|---|---|---|---|
| 2,798,164 | 7/1957 | Untermyer | 250/497.1 |
| 3,147,383 | 9/1964 | Prest | 250/497.1 |
| 3,170,065 | 2/1965 | Prest | 250/497.1 |
| 3,393,317 | 7/1968 | Spencer | 250/497.1 |
| 3,511,997 | 5/1970 | Seaman | 250/497.1 |
| 3,848,137 | 11/1974 | Ellis | 250/497.1 |
| 4,150,298 | 4/1979 | Brault et al. | 250/497.1 |
| 4,370,555 | 1/1983 | Brethon et al. | 378/120 |

*Primary Examiner*—Janice A. Howell
*Assistant Examiner*—Don Wong
*Attorney, Agent, or Firm*—Murray E. Thrift; Stanley G. Ade; Adrian D. Battison

[57] ABSTRACT

Elongated, flexible radiography source assemblies are inserted into radiological cameras using an inserter apparatus into which the source assembly is dropped and which aligns the source assembly with two ports connected to a pair of tubes. The tubes are connected through a routing apparatus to the camera and a cable drive so that the source assembly can be driven from the inserter into the camera in the correct orientation.

21 Claims, 5 Drawing Sheets

APPARATUS FOR HANDLING SOURCE CAPSULE ASSEMBLIES

FIELD OF THE INVENTION

This invention relates to an apparatus for handling radioactive source assemblies for radiological cameras and more particularly for inserting such assemblies into a camera or other container.

BACKGROUND

When using radiological cameras of the type designed for gamma radiography, it is at times necessary to transfer the radioactive source assembly from a position where it has become disconnected from the control cable and is outside the camera or is in a shielded container other than the camera and has to be moved into the camera. The present invention is concerned with an apparatus for use in this transfer.

SUMMARY

According to one aspect of the present invention there is provided an apparatus for inserting a radioactive source assembly into a container comprising:

an insertion tube having an inlet end and an outlet end;

first coupling means for coupling the outlet end of the insertion tube to the container for transferring the source assembly from the tube to the container;

source inserter means including first and second ports, means for receiving the source and means for aligning the source with the first and second ports;

cable means including a flexible drive cable and means for advancing and retracting the cable;

second coupling means connecting one of the ports of the inserter means to the inlet end of the insertion tube and connecting the other of the ports of the insertion means to the cable means for receiving the flexible drive cable therefrom whereby the source assembly may be placed in the inserter means, aligned with the first and second ports and driven from the inserter means through the insertion tube into the container by the flexible drive cable of the cable means.

The apparatus enables the operator to transfer the assembly to a camera or other container without approaching the unshielded source closer than required for placing the assembly in the insertion means when using regulation length radiography tongs.

According to another aspect of the present invention there is provided an apparatus for inserting a radioactive source assembly into a tube, comprising:

first channel means, opening upwardly for receiving the source assembly therealong;

first and second guide means on opposite sides of the first channel means and converging downwardly to opposite sides of the first channel means for guiding the source assembly into the first channel means when it is placed between the first and second guide means;

second channel means moveable relative to the first channel means between an open position spaced from the first channel means for allowing the source assembly to enter the first channel means and a closed position overlying the first channel means and cooperating therewith to define a conduit in which the source assembly is slideable; and coupling means for coupling one end of the tube to the apparatus for receiving the source assembly from the conduit.

The assembly may be picked up using tongs and dropped into the top funnel-shaped opening of the inserter. Then, still using the tongs or other simple controls, the apparatus is closed. The assembly is then longitudinally aligned in the conduit such that a cable may pass along the tube propelling the assembly into the tube and thence to the camera or other container.

The apparatus is preferably equipped with a restrictor engageable with a locking ball on the source assembly so that if the source assembly is not facing the right way around for entry into the camera, the source assembly will not move from the apparatus until the routing of the cable is changed such that the cable enters the invention at the opposite end. The apparatus preferably includes a re-routing unit for this purpose.

BRIEF DESCRIPTION OF THE DRAWINGS

In the accompanying drawings, which illustrate exemplary embodiments of the present invention.

DETAILED DESCRIPTION

Figure 1:
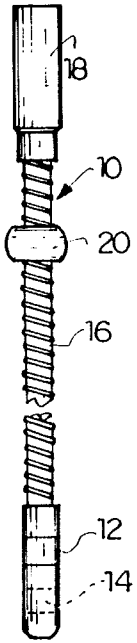
FIG. 1 is a side view, partially in cross-section of a typical radiography source assembly.
Figure 5:
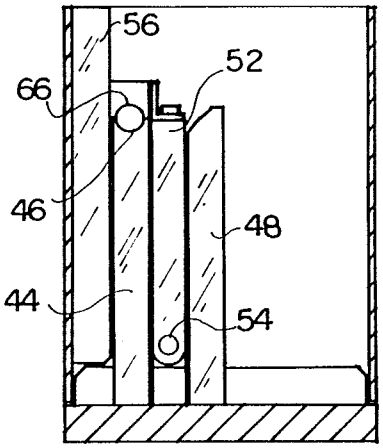
FIG. 5 is a view like FIGS. 3 and 4 but showing the apparatus in the closed position.
Figure 4:
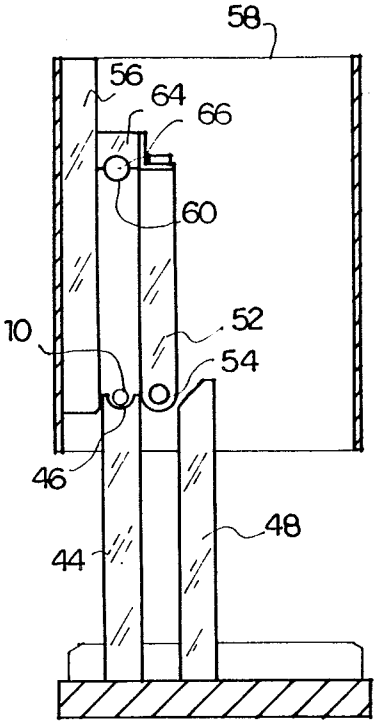
FIG. 4 is a view like FIG. 3 but showing the apparatus in partially closed condition.

Referring to the accompanying drawings, and especially to FIG. 1, there is illustrated a radioactive source assembly 10 for use in radiological cameras of the type designed for gamma radiography. The source assembly includes a capsule 12 housing the radioactive source 14. The capsule is connected to one end of a pig tail cable 16, which is in turn connected at the other end to a female connector 18. The female connector may be connected to a male connector at the end of a drive cable when the assembly is in the camera for manipulation of the source assembly. The pig tail cable 16 carries a looking ball 20 which is used in conjunction with a locking device in the camera for locking the source assembly in a retracted position. This radioactive source assembly is conventional in its construction.

Figure 2:
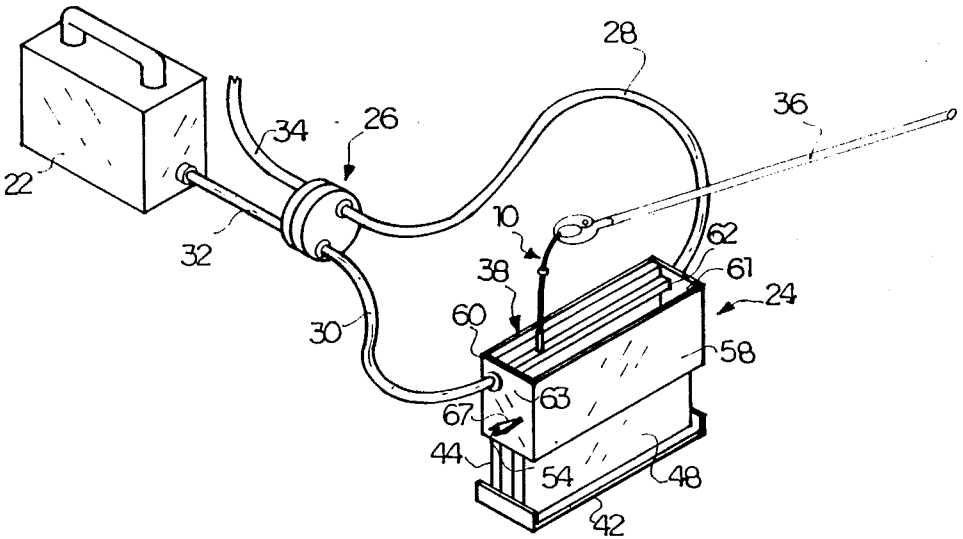
FIG. 2 is a pictorial representation showing a camera, an insertion apparatus and a re-routing mechanism, with a source assembly about to be placed into the insertion apparatus from a set of tongs.

Referring to FIG. 2 of the drawings, there is illustrated an apparatus for inserting a source such as that illustrated in FIG. 1 in a radiological camera 22. The apparatus includes an inserter apparatus 24 and a routing apparatus 26 joined by tubes 28 and 30 for inserting the source assembly 10 into an insertion tube 32 using a drive cable running in a cable tube 34 connected to the routing apparatus 26. The source assembly 10 is placed into the open top 38 of the insertion apparatus 24 using regulation radiography tongs 36. The inserter is subsequently manipulated to align the assembly 10 with the ends of the tubes 28 and 30 and the cable is driven through the inserter to drive the assembly along the insertion tube to the camera.

The construction of the inserter 24 is illustrated in FIGS. 2 through 9. The apparatus has a base 42 supporting the apparatus. A vertical plate 44 extends upwardly from the base and has a semi cylindrical channel 46 formed along its upper edge. A second plate 48 stands on the base 42, parallel to the plate 44. The plate 48 has a beveled upper surface 50 that engages a pivoting guide plate 52 to limit its movement about a pivot 54 located between and parallel to the plates 44 and 48. A second guide plate 56 is vertically oriented and located on an opposite side of the plate 44 from the plate 52.

The two guide plates are mounted in a rectangular housing 58. Two aligned circular ports 60 and 62 are formed in the respective end walls 61 and 63 of the housing. In the receiving position of the apparatus illustrated in FIG. 3, the ports are located vertically above the semi cylindrical channel 46 in the top of plate 44. A bar 64 extends from end to end of the housing, along the vertical guide plate 56. A semi cylindrical, downwardly opening channel 66 is formed in its bottom surface. The channel 66 aligns with the upper edges of the ports 60 and 62.

Figure 3:
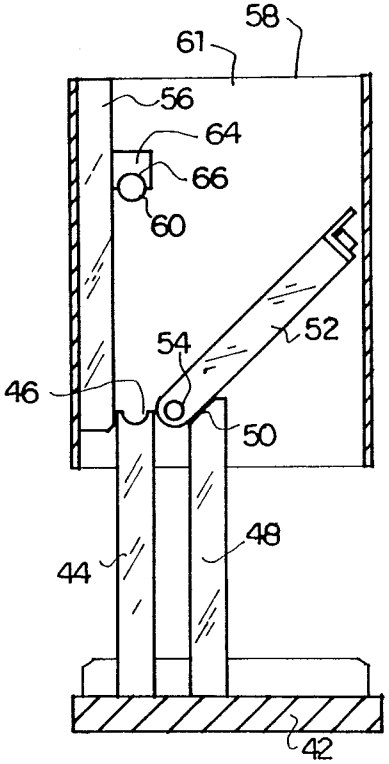
FIG. 3 is a cross-sectional view of the insertion apparatus in the open position ready to receive a source assembly.
Figure 6:
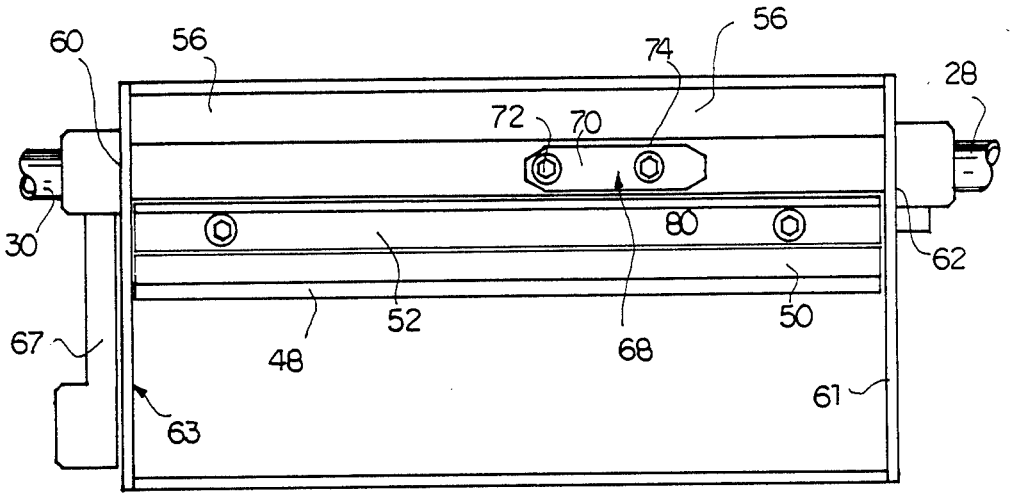
FIG. 6 is a plan view of the apparatus showing a restrictor.

In use of the inserter, it is initially arranged with the components in a receiving position as illustrated in FIG. 3. The housing 58 is raised off the base 42 and the guide plate 52 is pivoted away from the guide plate 56 so that the two converge towards the channel 46. The guide plate 52 is supported on the beveled surface 50 of the plate 48. A source assembly 10 dropped into the top of the housing 58 will then be directed by the sloping guide plate 52 into the channel 46. The plate 52 is then brought to a vertical position by pivoting about the pivot 54 towards the guide plate 56. Plate 52 reaches a vertical orientation illustrated in FIG. 4, confining the source assembly 10 between the guide plates in the channel 46. The housing is then lowered on the plates 44 and 48, towards the base, thus bringing the bar 64 onto the top of the plate 44 so that the channels 46 and 66 cooperate to define a cylindrical conduit confining the source assembly in alignment with the ports 60 and 62 in the end walls of the housing. The guide plate 52 slides into the space between plates 44 and 48 as the housing is lowered.

In the receiving position, the plate 48 supports guide plate 52 and acts to prevent movement of the housing and the upper channel to the closed condition.

The movement of the guide plate 52 between its receiving position (FIG. 3) and its retaining position (FIG. 4) is effected with a lever 67 fixed to the pivot 54 on the outside of the housing 58.

Figure 7:
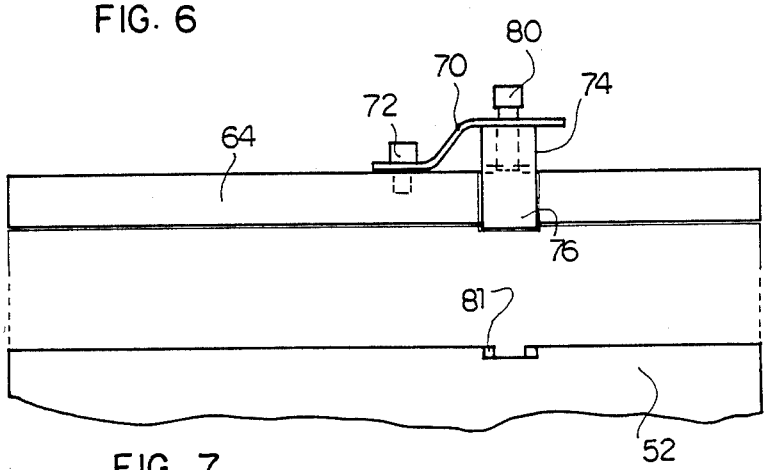
FIG. 7 is a side elevation of top and bottom channel parts of the insertion apparatus including the restrictor.
Figure 8:
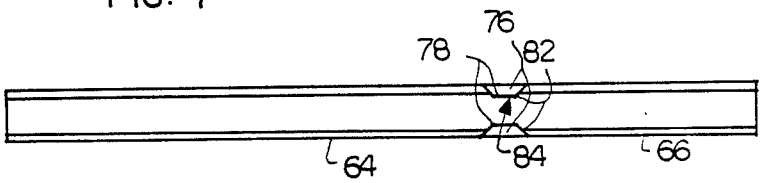
FIG. 8 is a bottom view of the top channel, including the restrictor.

To ensure that the source assembly 10 is driven from the inserter 24 the right way around for insertion into the camera 22, the inserter is equipped with a restrictor 68 that engages the locking ball 20 on the source assembly to limit its movement out of the inserter to one direction only, that is with the female connector 18 leading. The restrictor 68 includes an S-shaped spring 70 secured to the top of the bar 64 by cap screw 72. An inverted U-shaped restrictor block 74 is fitted onto the bar with its legs 76 extending along vertical grooves 78 in the sides of the bar. The block is connected to the spring 70 by a cap screw 80 that is threaded into the block 74 and bears on the top of the bar 64. Threading the cap screw through the block raises the block against the action of the spring 70 to an inactive position. As illustrated most particularly in FIG. 8, the legs 76 of the block project into the channel 66 in the bar 64. They also extend into grooves 81 in the plate 52 to project into the sides of channel 46. The legs have chamfers 82 along their vertical edges and cooperate to restrict the conduit formed by the two channels 46 and 66 at a throat 84 through which the locking ball 20 cannot pass. This means that a source assembly housed in the conduit can be driven from the conduit to the right as seen in FIGS. 7 and 8, while it cannot be driven to the left as seen in those figures unless the female connector and locking ball are to the left of the restrictor and the source capsule is to the right. All of the drawings show the initial position of the system at the time when the source assembly is received. If the female connector and locking ball are to the right of the restrictor as seen in FIG. 8, the source assembly will not exit to the left.

Figure 9:
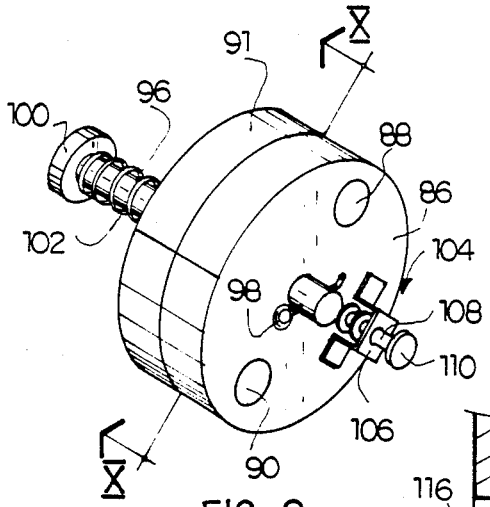
FIG. 9 is an isometric view of the re-routing mechanism.
Figure 9A:
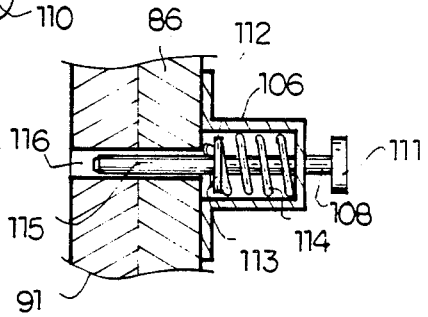
FIG. 9A is a detail of FIG. 9.
Figure 10:
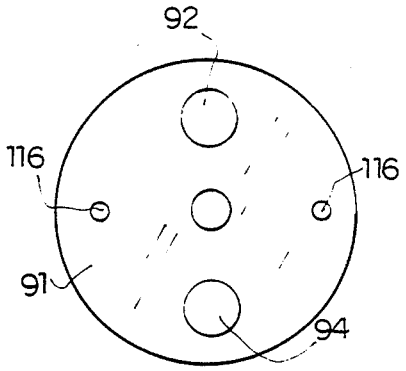
FIG. 10 is a view along line X—X of FIG. 9.

The routing apparatus 26 serves to couple the port 60 of the inserter to either the camera or the cable drive while coupling the port 62 of the inserter to the other of the camera and the cable drive. This allows the cable to drive the source assembly from the inserter into the camera, regardless of which way around it has been placed in the inserter. The construction of the router 26 is most clearly illustrated in FIGS. 9 and 9A. It includes a disk-like rotor 86 with two ports 88 and 90 spaced from the centre of the rotor on a common diameter. A second disk-like rotor 91 is in face to face engagement with the rotor 86 and has two ports 92 and 94 aligned with the ports 88 and 90. The rotors are held together with a pin 96 extending through the centres of the two rotors and held in place with a cotter pin 98. At the opposite end of pin 96, head 100 retains a coil spring 102 on the pin to bias the two rotors into engagement with one another.

A latch 104 is mounted on the rotor 86 and includes a U-shaped bracket 106 secured to the outer face of the rotor 86. A pin 108 extends through the end of the bracket with its head 110 on the outside. Inside bracket 106, the pin carries a washer 112 retained by a cotter 113. A coil spring 114 is captured between the base of the bracket 106 and the washer 112 to bias the pin towards the rotor 86 on which it is mounted. Under this bias, the pin extends into a locking aperture 115 in the rotor 86, and an aligned one of two locking apertures 116 in the rotor 91.

Figure 11:
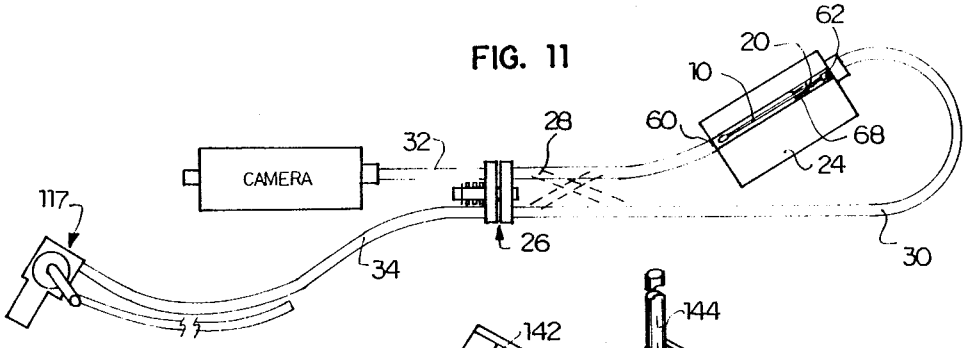
FIG. 11 is a schematic view of the entire apparatus.

By releasing the pin 108 of latch 104 from a locking aperture 116, the two rotors can be rotated 180° with respect to one another and then latched in place so that the alignment of the ports is reversed. The effect of this is illustrated most clearly in the schematic drawing of FIG. 11. In that drawing, the source assembly 10 . is illustrated as being housed within the inserter 24 in alignment with the ports 60 and 62. The router 26 is arranged such that the port 60 is connected through the tube 28 to the insertion tube 32, which leads to the camera. The port 62, on the other hand, is connected by the tube 30 to the router 26, which is coupled to the cable drive tube 34. This is in turn connected to the cable drive unit 117 which is conventionally used with cameras of the type in question. The cable drive unit has a cable housing 118 attached to it. This holds the loose end of the drive cable. The housing is a blind housing with a plug in the end and should be as long as tubes 32, 28 and 30 together.

If the source assembly is located in the inserter 24 with the capsule facing towards the port 60, the locking ball 20 will be between the restrictor 68 and the port 62. This means that any attempt to drive the source assembly out of the inserter using the cable drive will simply drive the source assembly forwards until the locking ball engages the restrictor, thus preventing the source assembly from being inserted into the camera backwards. To correct this, the router 26 is released by pulling on the latch pin 108, rotating the two rotors 180° with respect to one another so that the tube 28 then connects the port 60 to the cable drive, while the tube 30 connects the port 62 to the insertion tube. Actuation of the cable drive then will drive the source assembly out of the inserter into the insertion tube in the correct orientation without manipulation of the source assembly by the operator.

Figure 12:
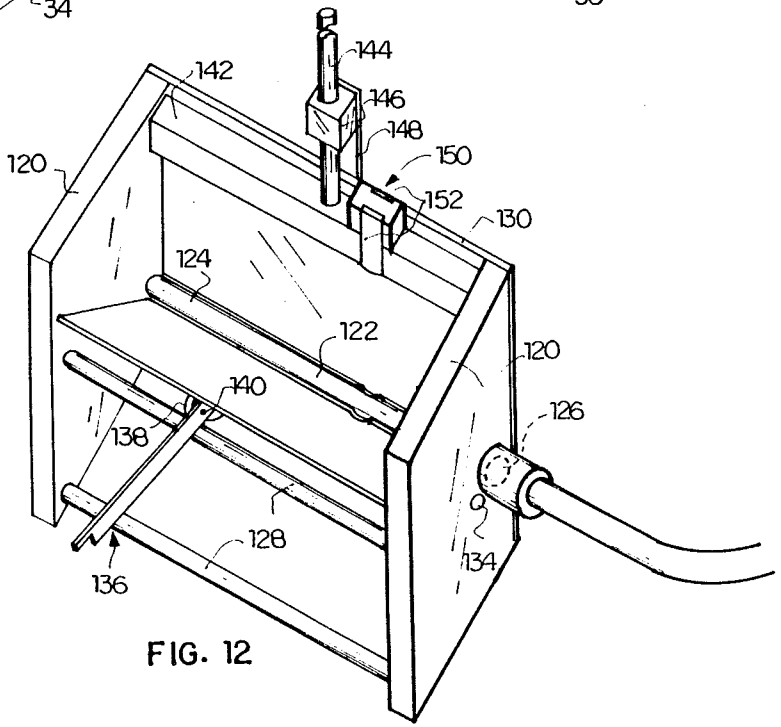
FIG. 12 is an isometric view of an alternative embodiment of the insertion apparatus.

An alternative, and somewhat simplified version of the inserter is illustrated in FIG. 12. That inserter includes two end plates 120. An upwardly open channel 122 extends between the end plates in alignment with ports 124 and 126 in the respective end plates. The end plates are also joined by a pair of spacer rods 128 and a fixed, vertical guide plate 130 that extends along one side of the channel 122. A second guide plate 132 extends between the end plates and is pivotally mounted on them by means of pivots 134, only one of which has been illustrated. A latch 136 is connected to the guide plate 132 by a lug 138 and a pin 140. The latch is a bar, notched at one end to engage one of the rods 128 to hold the guide plate 132 in place when it is in the retaining position. The upper channel 142 is in this case mounted on a vertical rod 144 that runs through a block 146 carried on a bracket 148. The channel 142 carries a restrictor 150 with legs 152 that extend into the channels 142 and 122 ensure unidirectional passage of the source assembly from the apparatus.

In use of this embodiment, the guide plate 132 and the rod 144 must be manipulated separately by the operator using tongs as a manipulator. The source assembly is retained in a conduit defined by the two channels meeting face to face.

While specific embodiments of the present invention has been described in the foregoing, it is to be understood that other embodiments are possible within the scope of the invention. For example, the moveable guide plates and the moveable channel half may be displaced using a remote control arrangement, for example a control wire or linkage. The invention is thus to be considered limited solely by the scope of the appended claims.

I claim:

1. An apparatus for inserting a radioactive source assembly into a container comprising:

an insertion tube having an inlet end and an outlet end;

first coupling means for coupling the outlet end of the insertion tube to the container for transferring the source assembly from the tube to the container;

source inserter means including first and second ports, means for receiving the source assembly and means for aligning the source assembly with the first and second ports;

cable means including a flexible drive cable and means for advancing and retracting the cable;

second coupling means connecting one of the ports of the inserter means to the inlet end of the insertion tube and connecting the other of the ports of the insertion means to the cable means for receiving the flexible drive cable therefrom whereby the source assembly may be placed in the inserter means, aligned with the first and second ports and driven from the inserter means through the insertion tube into the container by the flexible drive cable of the cable means.

2. An apparatus according to claim 1 wherein the second coupling means comprise routing means for selectively coupling the inlet end of the insertion tube and the cable means alternatively to the first and second ports respectively and the second and first ports respectively of the inserter means.

3. An apparatus according to claim 2 wherein the routing means comprise a first rotor with a first rotor port connected to the cable means and a second rotor port connected to the insertion tube, a second rotor with third and fourth ports connected to the respective first and second ports of the insertion means and means coupling the rotors for relative rotation between one position with the first and second rotor ports aligned with the third and fourth rotator ports respectively and another position with the first and second rotor ports aligned with the fourth and third rotor ports respectively.

4. An apparatus according to claim 3 including latch means for latching the rotors together in the two positions.

5. An apparatus according to claim 1 wherein the inserter means comprise:

first upwardly open channel means for receiving the source assembly therealong;

first and second guide means on opposite sides of the first channel means and converging downwardly to opposite sides of the first channel means for guiding the source assembly into the first channel means when it is placed between the first and second guide means;

second channel means moveable with respect to the first channel means between an open position spaced from the first channel means for allowing the source assembly to enter the first channel means and a closed position overlying the first channel means and cooperating therewith to define a conduit aligned with the first and second ports of the source inserter means.

6. An apparatus according to claim 2 including restrictor means for preventing the source assembly from being transferred from the inserter means to the insertion tube in a predetermined orientation.

7. An apparatus according to claim 6 wherein the restrictor means comprise a restricted size passage in the inserter means for preventing the passage of an enlarged portion of the source assembly.

8. An apparatus according to claim 5 wherein the first guide means comprise a substantially vertical guide extending upwardly from one side of the first channel means.

9. An apparatus according to claim 8 wherein the second guide means comprise a moveable guide extending from a second side of the first channel means and guide mounting means mounting the moveable guide for movement between a receiving position sloping upwardly and outwardly from the second side of the first channel means and a retaining position extending upwardly substantially parallel to the first guide means.

10. An apparatus according to claim 9 wherein the second guide means is coupled to the first guide means, with both guide means being moveable vertically with the second channel means with respect to the first channel means.

11. An apparatus for inserting a radioactive source assembly into a tube, comprising:

first channel means, opening upwardly for receiving the source assembly therealong;

first and second guide means on opposite sides of the first channel means and converging downwardly to opposite sides of the first channel means for guiding the source assembly into the first channel means when it is placed between the first and second guide means;

second channel means moveable relative to the first channel means between an open position spaced from the first channel means for allowing the source assembly to enter the first channel means and a closed position overlying the first channel means and cooperating therewith to define a conduit in which the source assembly is slideable; and coupling means for coupling one end of the tube to the apparatus for receiving the source assembly from the conduit.

12. An apparatus according to claim 11 wherein the first guide means comprise a substantially vertical guide extending upwardly from one side of the first channel means.

13. An apparatus according to claim 12 wherein the second guide means comprise a moveable guide extending from a second side of the first channel and guide mounting means mounting the moveable guide for movement between a receiving position sloping upwardly and outwardly from the second side of the first channel means and a retaining position extending upwardly substantially parallel to the first guide means.

14. An apparatus according to claim 13 wherein the second channel means comprise a downwardly open channel mounted on the first guide means.

15. An apparatus according to claim 14 wherein the second channel means is fixed to the first guide means.

16. An apparatus according to claim 15 wherein the second guide means is coupled to the first guide means, both guide means being moveable vertically with the second channel means with respect to the first channel means.

17. An apparatus according to claim 16 including means responsive to the moveable guide being in the receiving position to prevent movement of the second channel means to the closed position.

18. An apparatus according to claim 13 wherein the first channel means is fixed to the first guide means.

19. An apparatus according to claim 18 wherein the second channel means is movably mounted on the first guide means for movement between the open and closed positions.

20. An apparatus according to claim 11 including restrictor means for preventing the source assembly from sliding out of the conduit into the tube in one orientation of the source assembly.

21. An apparatus according to claim 20 wherein the restrictor means comprise a restriction in the conduit for preventing the passage of an enlarged portion of the source assembly.

* * * * *